United States Patent [19]

Alomar

[11] 4,187,564

[45] Feb. 12, 1980

[54] INFANTS COT

[76] Inventor: Antonio D. Alomar, Paseo Maritimo 12, Edificio Bellver, Palma de Mallorca, Balearic Islands, Spain

[21] Appl. No.: 890,870

[22] Filed: Mar. 28, 1978

[30] Foreign Application Priority Data

Apr. 4, 1977 [ES] Spain ..... 227.650[U]

[51] Int. Cl.[2] ..... A47D 7/04

[52] U.S. Cl. ..... 5/94; 5/99 B; 5/114

[58] Field of Search ..... 5/93, 99 R, 94, 99 B, 5/100, 104, 114; 297/440, 441

[56] References Cited

U.S. PATENT DOCUMENTS

| | | | |
|---|---|---|---|
| 114,292 | 5/1871 | Hazard | 5/104 |
| 700,001 | 5/1902 | Abell | 5/100 |
| 2,988,135 | 6/1961 | Caminiti | 5/94 |
| 4,075,720 | 2/1978 | Fleischer | 5/94 |

*Primary Examiner*—Casmir A. Nunberg
*Attorney, Agent, or Firm*—Omri M. Behr

[57] ABSTRACT

A folded frame assembly for an infants cot, the frame being foldable from a first substantially rectangular configuration to a compact configuration in which the members are in substantially superimposed alignment.

7 Claims, 10 Drawing Figures

INFANTS COT

Prior Application: Priority, Spain, Apr. 4, 1977, Application No. 227,650.

The present invention relates to a folding frame assembly for an infants cot, particularly for such a cot as is used for travelling.

It is an object of the present invention to provide such a frame assembly that is simple to fold and erect and that folds into a small and convenient bundle.

The present invention is a frame assembly for an infants cot, including a pair of end frames each having four members pivotally interconnected by three joints and being foldable from a first substantially rectangular configuration to a second configuration in whch the members are in substantially superimposed alignment.

An embodiment of the present invention will now be described, by way of example, with reference to the accompanying drawings, in which.

Figure 1:
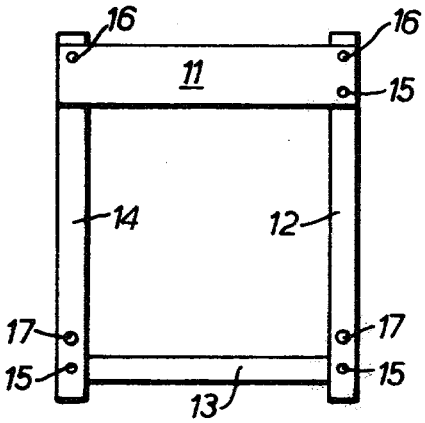
FIG. 1 is an elevation of an end frame of a folding frame assembly according to the present invention.

Referring now to the drawings, and in particular to FIG. 1, a substantially rectangular end frame 10 of a folding frame assembly comprises top and bottom members 11 and 13 respectively and side members 12 and 14. The top member 11 is attached to the side member 12, the latter to the bottom member 13 and the latter in turn to the side member 14 by means of pivotal connections 15, in this embodiment rivets. In addition to this two clearance holes 16 are formed in the top part of the top member 11, to coincide exactly with clearance holes formed in the top part of the side members 12 and 14. At the bottom ends of these side members, above the location of the bottom member 13, similar clearance holes 17 are formed.

Figure 7:
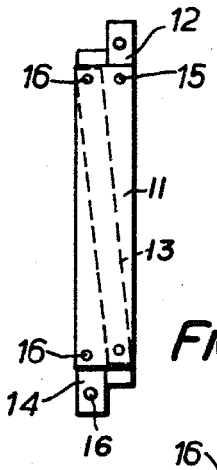
FIGS. 7–9 illustrate stages in the erection of the end frame of FIG. 1
Figure 8:
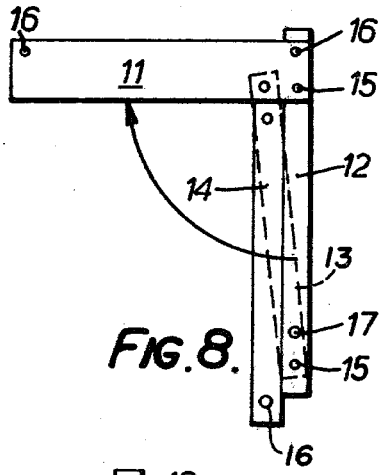
Figure 9:
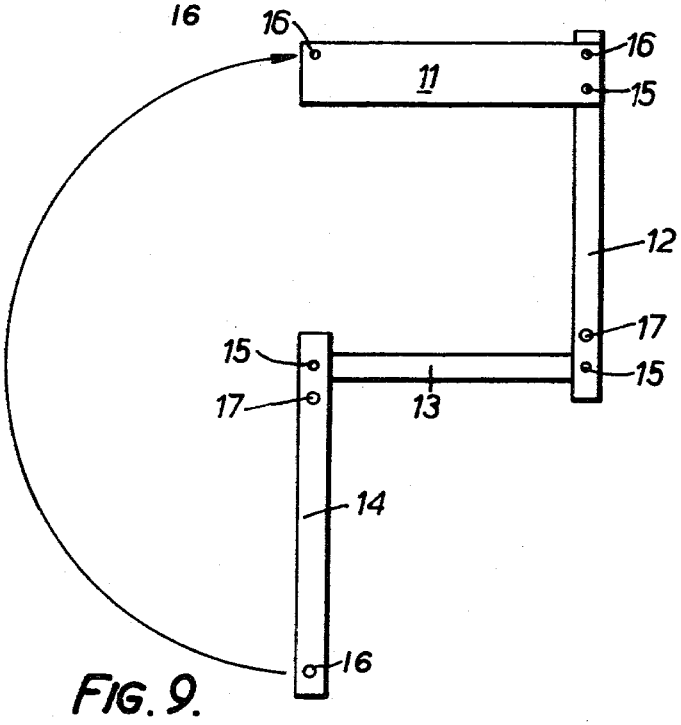

Assuming the end frame 10 to be in the folded state as shown in FIG. 7 of the attached drawing in which the members 11 to 14 are in substantially superimposed alignment, in order to make it ready for use the first step is to place the top member 11 in a horizontal position by swinging it backwards through 90° about its articulated joint on the side member 12 which is maintained in the vertical attitude (FIG. 8). This is followed by the joint folding downwards through 90° of the hitherto bottom member 13 and the side member 14 so that the former occupies a horizontal attitude and the latter, commencing from this position, executes a full 270° swing into the vertical working position, bringing its clearance hole 16 opposite the corresponding one in the top member 11 (FIG. 1).

Figure 2:
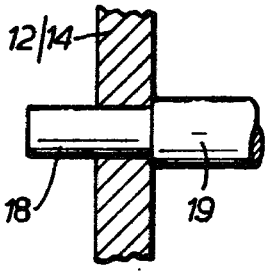
FIG. 2 is a detail view showing how bottom bracing elements are connected to the end frame of FIG. 1.
Figure 3:
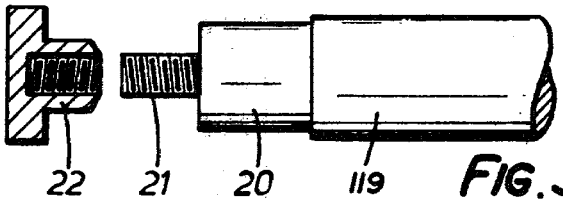
FIG. 3 illustrates the end of a top bracing element for the frame of FIG. 1.
Figure 4:
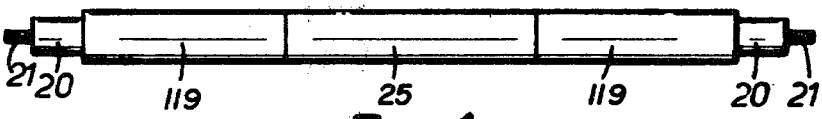
FIG. 4 is a view of a top bracing element.
Figure 5:
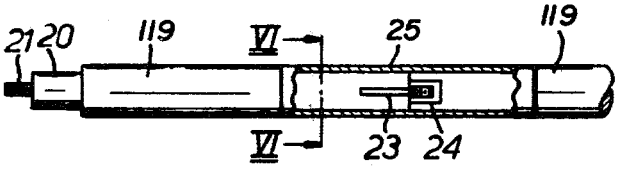
FIG. 5 is a fragmentary view of the element of FIG. 4, partly broken away to illustrate the internal construction.
Figure 6:
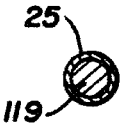
FIG. 6 is a cross section on the line VI—VI of FIG. 5.

These operations having been performed for both end frames, i.e. at the top and bottom ends of the cot, the next step is to introduce the bottom bracing elements 19, these having an appropriate cross-section and terminal spigots 18 (FIG. 2) which locate in and pass through the clearance holes 17 formed in the bottom ends of the side members 12 and 14. This is followed by the bracing elements 119 which have at their ends spigots 20 and threaded extensions 21 (FIG. 3). The spigots 20 are fitted into the top holes 16 in the side members and at the same time the threaded extensions pass through the corresponding openings in the top member 11 to be engaged by fixing nuts 22 which are tightened down to hold together and stabilize the complete frame assembly.

In order to reduce the length of the top and bottom bracing elements and 119, each is split into two equal halves with reduced central zones where a sleeve 25 is fitted to establish and protect the joint formed by a screwed rod 23 or the like incorporated in one of the halves and a tapped hole 24 incorporated in the other.

Figure 10:
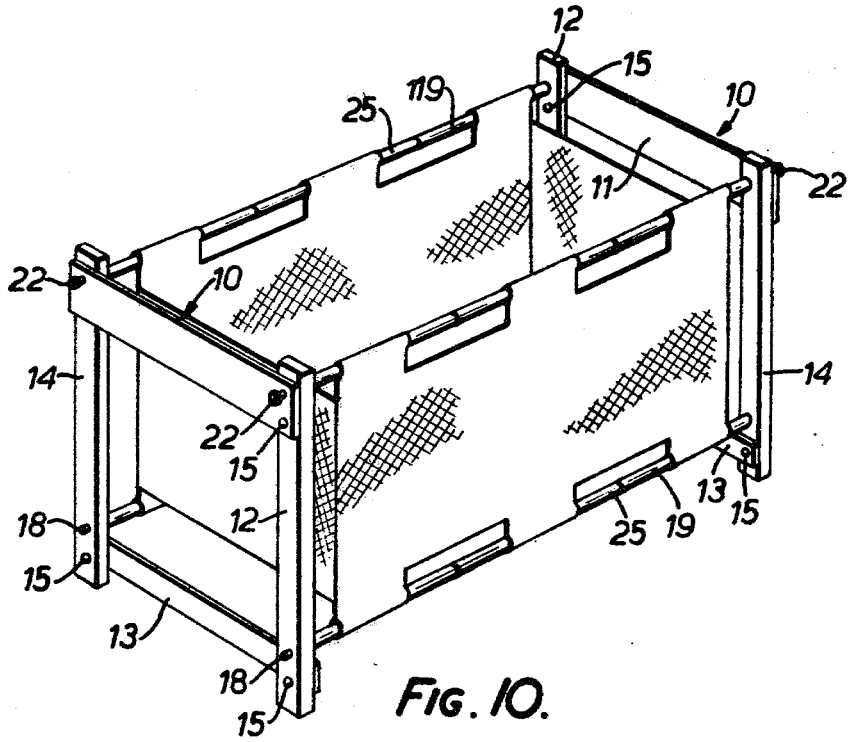
FIG. 10 is a perspective view of the cot fully erected.

Finally, the cot is finished off by a flexible fabric member of adequate strength containing appropriate loops to receive the bracing elements and suspended therefrom to form the sides and base of the cot, as shown in FIG. 10.

It can be seen that when the end frames are folded and placed togather with the dismantled bracing elements, a compact and convenient bundle is obtained.

I claim:

1. A frame assembly for an infant's cot, including a pair of end frames, each having four members pivotally interconnected by three joints and being foldable from a first substantially rectangular configuration to a second configuration in which the members are in substantially superimposed alignment, and bracing members for interconnection said pair of end frames, said pair of end frame members being secured in said first configuration by engagement with two of said bracing members.

2. A frame assembly as claimed in claim 1, in which each said bracing member comprises interconnected portions.

3. A frame assembly as claimed in claim 2, in which said portions are threadedly interconnected members.

4. A frame assembly as claimed in claim 2, including a sleeve located over the joint between said interconnected portions to conceal said joint.

5. A frame assembly as claimed in claim 1, in combination with a flexible member suspended from said frame assembly.

6. A frame assembly as claimed in 1, wherein said bracing members are fixed to said end frame by threaded means and further including two additional members, said two additional bracing members being received by mating apertures provided in said end frames.

7. A frame assembly as claimed in claim 5 wherein said flexible member is held in position by said two additional bracing members.

* * * * *